US005769353A

United States Patent [19]

Jühe et al.

[11] Patent Number: 5,769,353

[45] Date of Patent: Jun. 23, 1998

[54] METHOD OF INITIATING THE PREMATURE REPLACEMENT OF A ROLL OF MATERIAL

[75] Inventors: Hans-Helmut Jühe, Kempen; Matthias Rauhut, Hagen, both of Germany

[73] Assignee: Stora Feldmühle AG, Düsseldorf, Germany

[21] Appl. No.: 722,114

[22] PCT Filed: Apr. 7, 1995

[86] PCT No.: PCT/EP95/01282

§ 371 Date: Sep. 26, 1996

§ 102(e) Date: Sep. 26, 1996

[87] PCT Pub. No.: WO95/27676

PCT Pub. Date: Oct. 19, 1995

[30] Foreign Application Priority Data

Apr. 8, 1994 [DE] Germany ..... 44 12 075.3
Nov. 26, 1994 [DE] Germany ..... 44 42 154.0

[51] Int. Cl.[6] ..... B65H 26/00; B65H 18/08; B65H 43/00; B65H 63/00

[52] U.S. Cl. ..... 242/563; 242/534

[58] Field of Search ..... 242/563, 534, 242/912

[56] References Cited

FOREIGN PATENT DOCUMENTS 0580071 1/1994 European Pat. Off. .
4191647 7/1992 Japan .
2256855 12/1992 United Kingdom .

OTHER PUBLICATIONS

"Das Papier" Oct. 1991, pp. 73–78, H.H. Jühe, Praxiserfahrungen mit Grossen Durchmesser.

*Primary Examiner*—John Q. Nguyen
*Attorney, Agent, or Firm*—Cohen, Pontani, Lieberman, Pavane

[57] ABSTRACT

A process for initiating a premature roll change of a web to be unwound from a roll wound on a spool, the process including the steps of measuring temperature at an end of the roll in a zone up to 150 mm away from a surface of the spool in a radial direction during a time that the roll has between 100% and 60% of its fully wound weight, using a non-contact measuring device, determining a radial distance from the spool surface when a temperature difference≧0.5° C. is found between temperature measurement locations in the zone and cooler adjacent areas, and storing the determined distance for triggering a signal that initiates a replacement of the roll when that distance is reached.

5 Claims, 4 Drawing Sheets

TEMPERATURES RECORDED ON ROTATING LWC BASE PAPER
WITH LOCAL TEMPERATURE INCREASES

METHOD OF INITIATING THE PREMATURE REPLACEMENT OF A ROLL OF MATERIAL

BACKGROUND OF THE INVENTION

1. Field of the Invention

The present application relates to a method of initiating the premature replacement of a material web, especially a paper web, that is unwound from a spool.

2. Description of the Prior Art

The term "spool" refers here to reels and winding cores of cardboard or metal.

In all winding processes, especially in the paper industry, larger and larger rolls are striven for. This is true of both diameter and width. However, winding technology runs into physical limits, which make it impossible to completely utilize the wound web material. Inside the rolls, i.e., in the so-called core region, defects such as web tears, core breaks and crepe folds occur directly on or directly above the spool. These phenomena are referred to hereinafter as "faults." Faults are all the more difficult to deal with because the statistical frequencies with which they occur fluctuate sharply.

This results inevitably in web breaks in downstream processing machines, accompanied by shutdowns and material losses. For safety reasons, therefore, not all of the material on a roll is subjected to further processing. Instead, a considerable quantity of leftover paper is left on the spool and must be recycled as spoilage.

As Juehe reports in the German reference "Practical Experiences in Producing Wide Gravure Printing Rolls with a Large Diameter" ("Praxiserfabrungen bei der Herstellung breiter Tiefdruckrollen mit grossem Durchmesser") in Paper (Das Papier) Vol. 45, 1991, No. 10a, pp. V73–V78, attempts have already been made to make the faults, e.g., winding folds and ridges, that occur during winding visible to the human eye by means of stroboscopic lighting. Nonetheless, a significant number of large rolls continue to be wound around clinic rollers for control purposes, in order to obtain information on the possible presence of faults whose development has not been detectable from the outside. The aforementioned reference also indicates that "problems near the spool (core breakers)" evidently do not arise until the web material is unrolled, and thus cannot be detected during winding.

Temperature changes discovered during the unwinding of a large reel (namely, a systematic temperature increase near the reel core, resulting from pressure change) as well as bending stresses and sliding movements detected in the core have led to the idea of developing another test and assessment process for winding technology. The characteristics of winding quality mentioned in the above article include roll hardness, roll structure, roll surface and roll shape (p. V76, right-hand column). An impetus to develop a method to detect existing faults is not found in this reference.

SUMMARY OF THE INVENTION

The present invention is based on the object of providing a process that permits the early detection of faults occurring in the core region during the production of rolls having large diameters and large web widths, especially in the paper industry, so that it is possible to manufacture large rolls that can be utilized up to the point of their physical winding limits and to minimize the number of remnant layers that must be left on the spool.

The inventors have realized that certain temperature phenomena can occur inside a certain area of the paper web layers located next to the spool. These phenomena allow the early recognition of faults to be exploited and permit a roll change to be initiated before the faults cause a rip in the web. The temperature phenomena in question are measurement points or areas with temperatures raised by a few tenths of a degree C. These hotter points or areas are not to be confused with the ring-shaped temperature phenomena also observed in the central region. These ring-shaped areas are higher in temperature than the web layers located farther from the spool.

Utilizing this newly obtained knowledge, the invention therefore suggests, in order to attain the stated object, a process for initiating the premature replacement of a web to be unwound from a spool, especially a paper web, which is characterized by the combination of the following features:

Using a non-contact temperature measuring device, the temperature is measured at the end of the spool, during the time that the roll being wound or unwound has between 100% and 60% of its fully wound weight, in a zone extending up to 150 mm from the surface of the spool in the radial direction.

When a temperature difference$\geqq$0.5° C. is found between measurement points or areas in the zone and cooler adjacent areas, the radial distance from the spool surface is determined.

The determined distance is stored for the purpose of triggering a signal that will initiate the replacement of the roll when that distance is reached.

Tests on the winding mechanisms of two paper machines have resulted in the typical temperature curve described below in approx. 90% of the measurements taken at the end of the paper roll. No significant differences have been found between individual grammages (base paper weight between 32 and 48 g/m$^2$) or paper types.

First, the paper emerges from the dry part of the paper machine at a high temperature. As winding proceeds, the temperature in the core region initially falls markedly as the reel gets farther from the nip. When the paper roll grows to over 60% of its final fully wound weight, the temperature in the core region stops falling. The trend of falling temperatures is reversed, and the temperature rises in a zone located approx. 5 to 150 mm, especially 10 to 80 mm, from the surface of the spool. A ring-shaped temperature area only several mm wide forms within the zone in the edge region of the roll. Detected temperature differences$\geqq$0.5° C. between temperature measurement points or areas within this narrow ring-shaped area and cooler adjacent portions of the ring-shaped area indicate faults, which can lead to web breaks during downstream unwinding.

The inventors' realization that the extent of the temperature increase is linked to faults in the core region of the roll permits faults to be detected by means of temperature monitoring for the first time, using the process according to the invention. In an advantageous embodiment of the process, both ends of the roll are monitored, because faults can occur arbitrarily in the edge region at either of the two ends and do not necessarily arise at both ends simultaneously.

It has been shown that the hotter points or areas occur in the edge region near the spool at the start of unwinding as well as toward the end of winding on the paper machine. It therefore makes no difference whether temperature monitoring is carried out during winding or unwinding.

If nothing notable is registered, the processing operation is carried out as desired by the processor and is optimized for the best possible material utilization.

If, on the other hand, a critical value is found, i.e., if a temperature difference≧0.5° C. relative to cooler adjacent locations is detected, then an alarm sent to the machine operator would suffice as the simplest form of reaction.

However, the automated process to initiate a premature roll change that is called for according to the invention, wherein control signals from the temperature measuring device trigger a roll replacement, has proved superior for obvious reasons.

The inventors have found that the formation of points or areas of increased temperature is more marked in coated than in uncoated papers. When coated LWC paper with a grammage of 75 g/m$^2$ was unwound, temperature differences of up to 1.6° C. occurred at the start of unwinding. Preferably, the temperature of the rolls is measured at both ends.

In a second embodiment of the invention, in order to attain the stated object, a process to initiate the replacement of a material web to be unwound from a spool, especially a paper web in rotary printing machines, is characterized by the combination of the following features:

While the roll is being unwound to the end in a zone 100 mm from the spool surface, non-contact temperature measurements are carried out above the material web being unwound, at the edge region as well as in the central region of the roll.

The detection of a temperature difference >0.5° C. between the edge of the roll and the center initiates, by means of control signals triggered by the temperature measurement device, an early replacement of the roll.

Although the increased heat in the core region of the roll occurs at the start of unwinding when the roll mass is large, locally heated points that indicate faults can be detected by measurement technology even when the unwinding process is far advanced. This is possible because locally heated points, due to a heat flow, can be found during unwinding in a larger area relative to the surrounding area. The crucial factor is the temperature difference between the center of the roll and the edge regions. The second embodiment according to the invention thus permits the early recognition of faults by means of temperature monitoring even when there is no access to the end of the roll, as is often the case in unwinding stations of rotary printing machines, because of their design.

In the second embodiment according to the invention, it has proved especially advantageous to carry out temperature measurements by means of an infrared camera that is equipped with a linear guide and traverses the entire width of the roll. A computer analyzes the temperature profile across the entire roll width. When the temperature difference between the central and the edge region of the roll exceeds a predetermined level, a control signal is sent to the changeover device in order to trigger the roll change procedure.

According to the invention, infrared cameras with resolution accuracy of at least 0.2° C. have proved effective. The average ambient temperature at which measurements are carried out is 30° C.

The processes according to the invention are not limited to use during the winding of paper webs. Heated spots also develop of the core region of the roll as its weight increases during the winding of webs of artificial fibers or foil.

BRIEF DESCRIPTION OF THE DRAWINGS

The following drawings serve to explain the invention in greater detail. The drawings show.

DETAILED DESCRIPTION OF THE PREFERRED EMBODIMENTS

Figure 1:
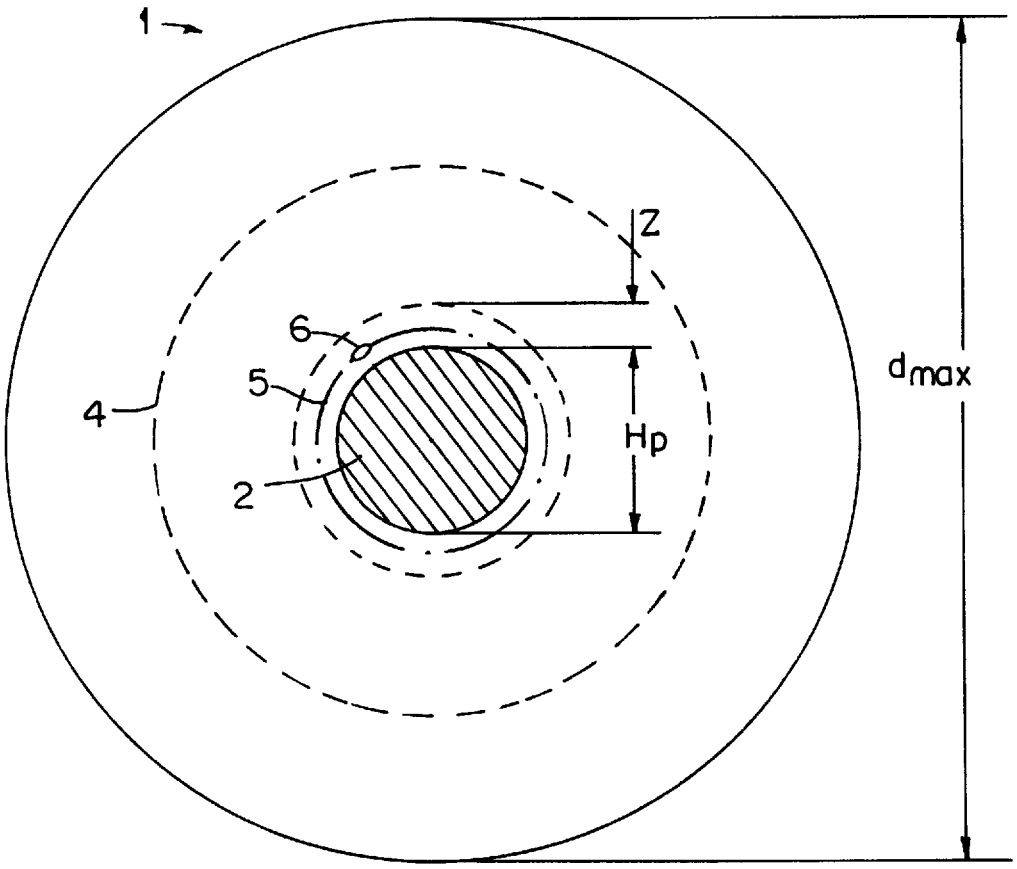
FIG. 1 The end of a roll, with a sketched ring-shaped temperature area and a measurement point of higher temperature.

FIG. 1 shows the end of the completely wound roll (1) shortly before its ejection from the winding device (not shown) of a paper machine. The roll (1) has a finished diameter of $d_{max}$=3.2 m and an inner or spool diameter of $d_H$=560 mm. The area of the spool (2) is indicated by hatched lines. A ring-shaped temperature area (5) several mm in width is shown by the thick dashed-dotted line within the zone marked in the radial direction by Z=150 mm. The circle (4) shown by the dashed line corresponds to 60% of the finished diameter and indicates the chronological start of temperature monitoring. When the finished diameter is attained, the paper layers in the ring-shaped temperature area (5) have a temperature that is 1.3° C. higher than the directly adjacent paper layers. The end of the roll (1) also has a local measurement point (6) with a temperature higher by 0.5° C. than the ring-shaped temperature area (5). The temperature gradation between the layers of the ring-shaped temperature area (5) and the local point (6) of increased temperature can be seen in FIGS. 4 and 5.

Figure 2:
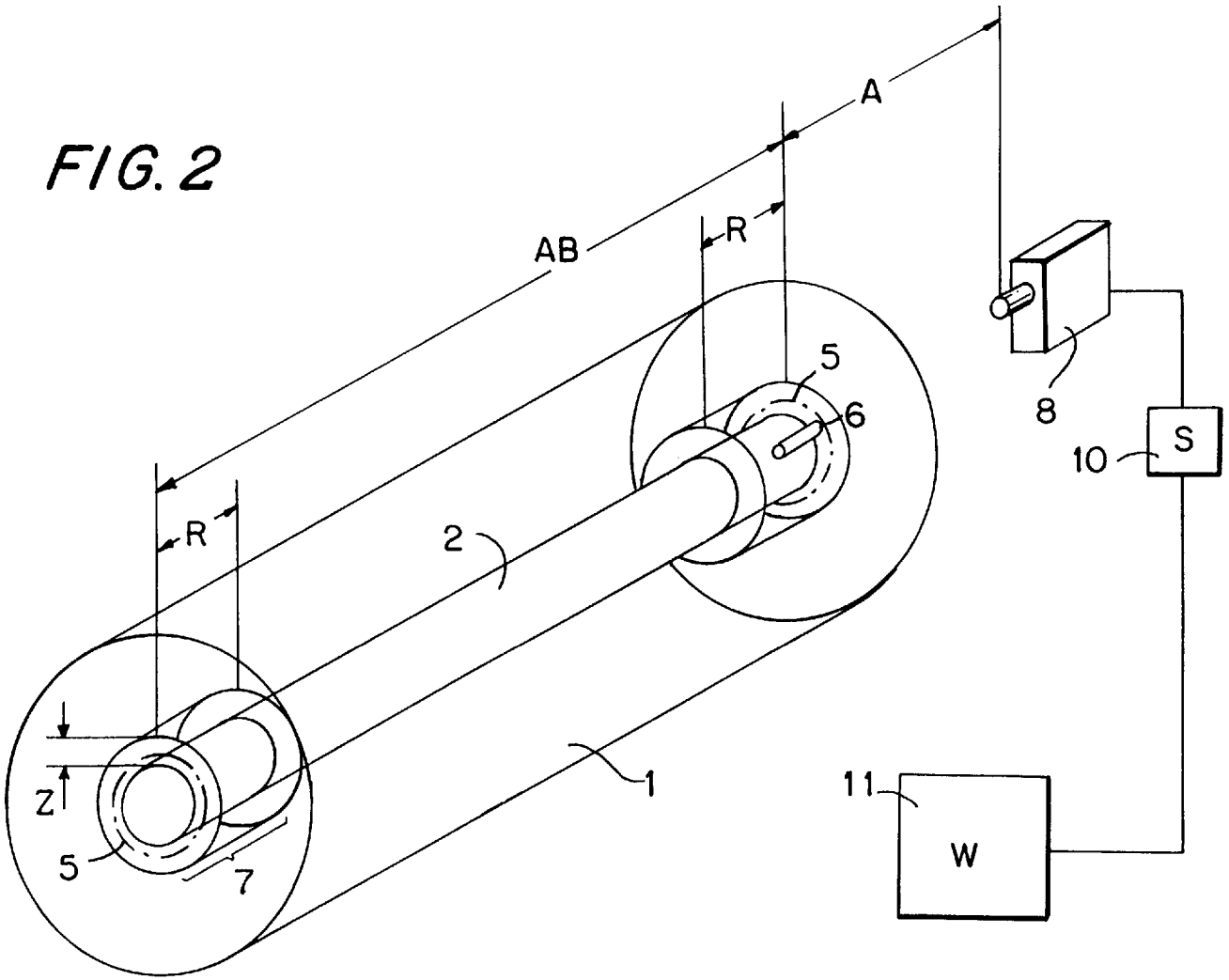
FIG. 2 A spatially-arranged schematic depiction of the process according to the invention.

In FIG. 2, the perspective drawing of the roll (1) shows the position of a ring-shaped temperature area (5) in the edge region (R) of the roll (1). This edge region (R), in which points or areas of higher temperature are observed, is described by a hollow cylinder wherein the inner diameter= the outer diameter of the spool (2), the wall thickness corresponds to zone Z=150 mm and the height (7) equals ⅛ of the roll width (AB). The hollow cylinder is shown by thin lines, whereas the ring-shaped temperature area (5) is again indicated by a thick dashed-dotted line.

An infrared camera (8) is arranged at a distance A=1.5 m, measured from the end of the roll. The measuring device of the infrared camera sends the locational coordinates, i.e., the radial distance from the spool surface, to a memory device (10) when a predetermined temperature difference of 1° C. (in this instance) is exceeded. The changing device (11) of the unwinding mechanism receives the stored locational coordinates and, upon reaching the location in question, triggers the premature roll replacement. If the measuring device of the infrared camera detects smaller temperature differences, the replacement procedure is not carried out until the wound web length has been completely utilized.

Figure 3:
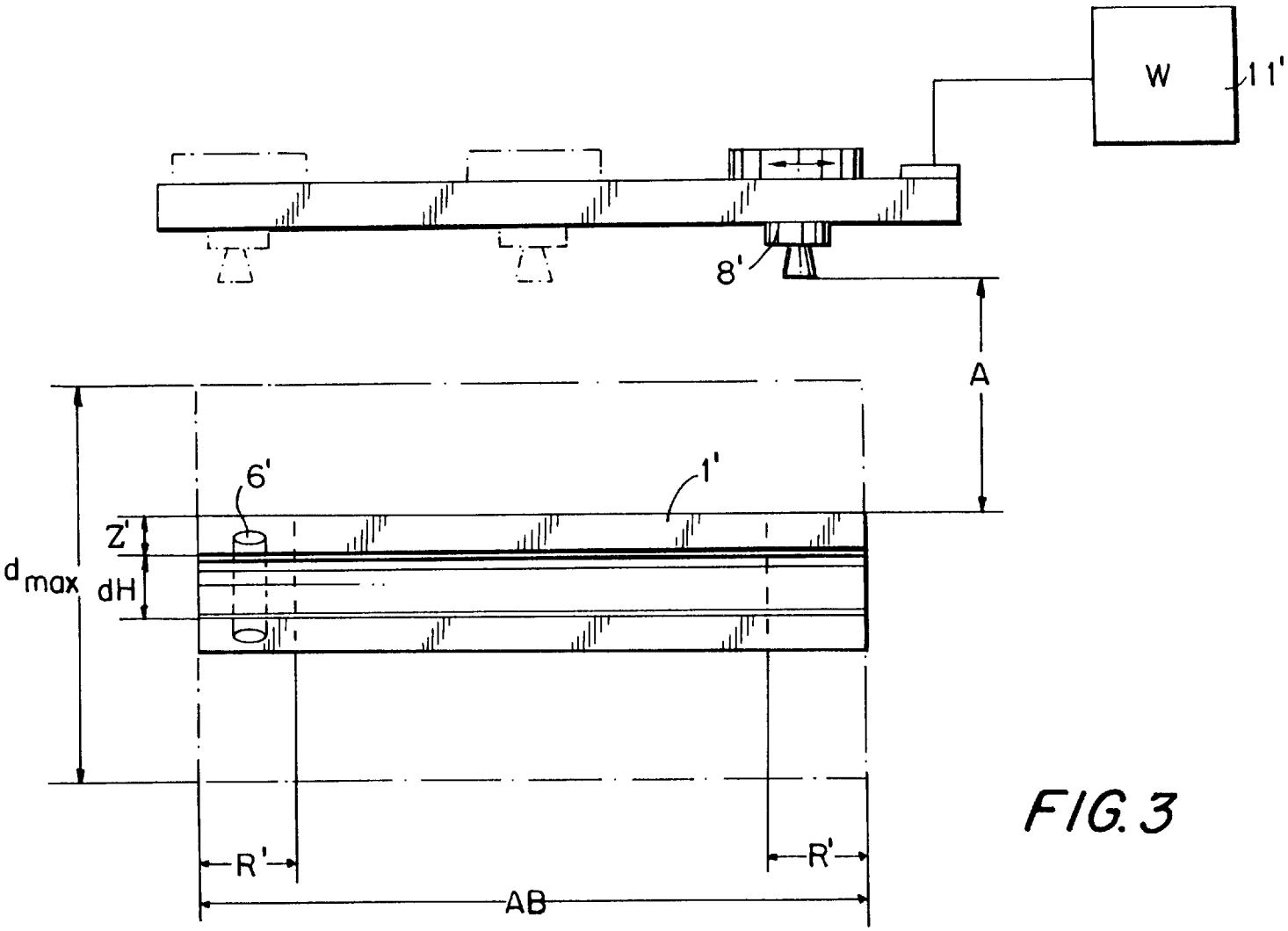
FIG. 3 A schematic depiction of the second embodiment of the process according to the invention.

FIG. 3 shows an alternative embodiment of the invention. The large roll (1') of LWC paper has the dimensions AB=3.2 m width, outer diameter $d_{max}$=1,250 mm and spool diameter $d_H$=150 mm. This roll (1') has already been unwound to a remaining thickness of Z'=100 mm. Due to the good insulation properties of paper, the temperature measurement area (6') created earlier when there was maximum roll mass has diminished only slightly relative to its surroundings during unwinding and even occupies a larger area. The traversing and continuously measuring infrared camera (8') registers the temperature profile across the width of the roll. An internal computer analyzes the temperature difference between the edges (R), which equal approx. ⅛ of the roll width, and the central region of the roll. When a predetermined temperature difference is found, the computer sends a control signal to the input of the changing device (11'), which then triggers the premature roll replacement. Here, too, web breaks were successfully avoided by monitoring the temperature during unwinding.

Figure 4:
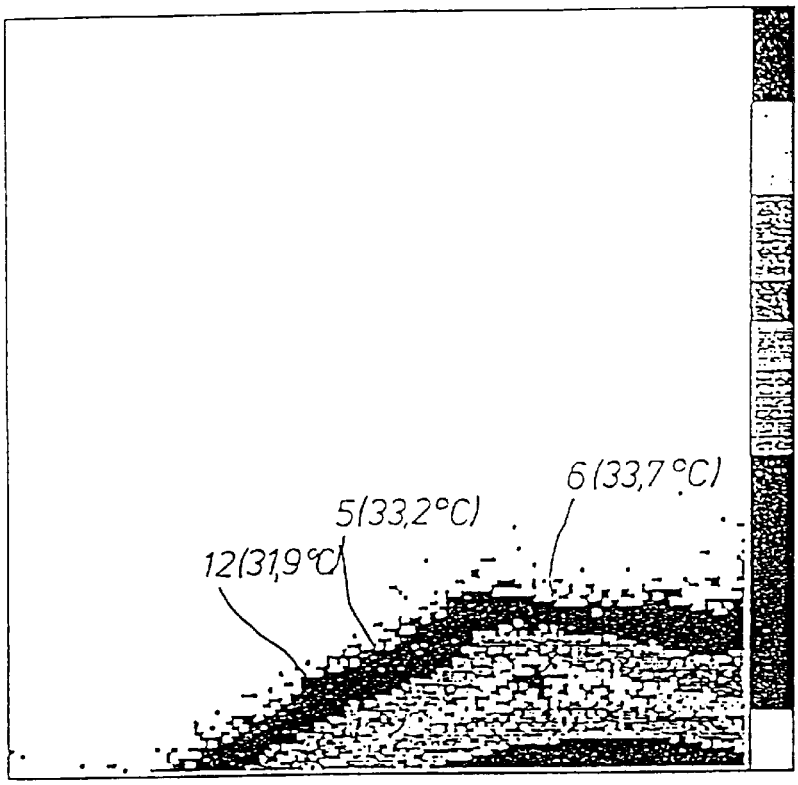
FIGS. 4 & 5 Infrared temperature recordings showing local temperature increases, recorded from the end of the roll.
Figure 5:
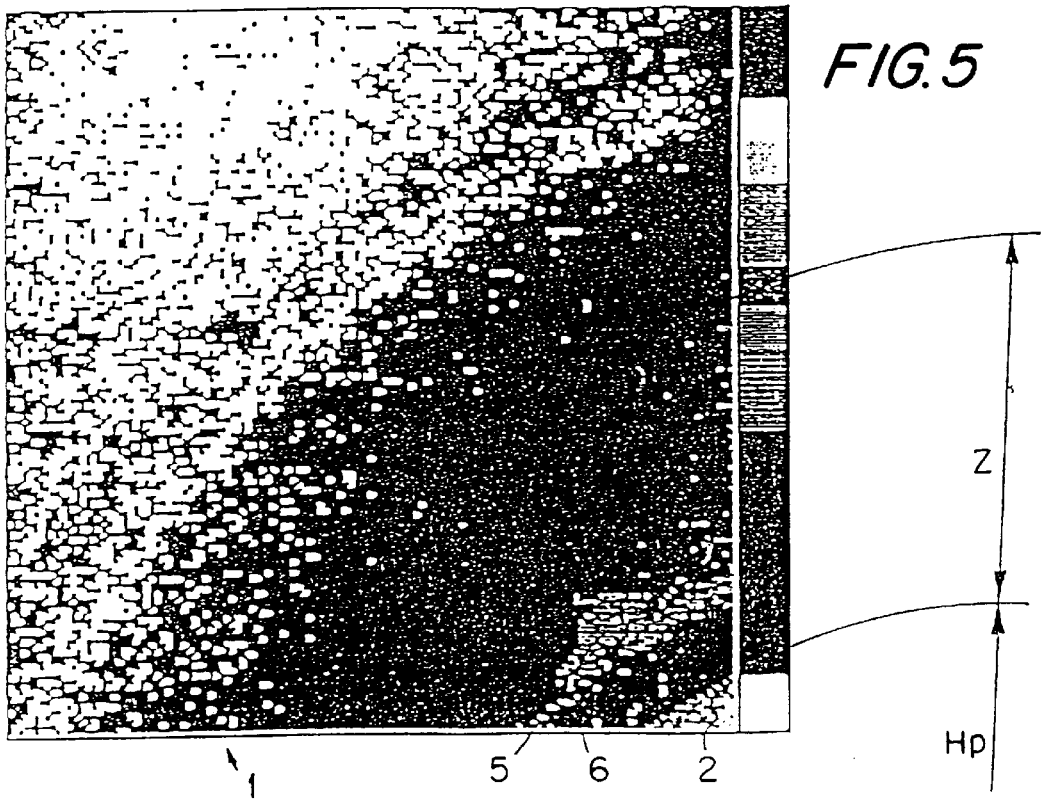

The infrared temperatures recorded on rotating LWC base papers are shown in FIGS. 4 and 5. For better orientation, the spool diameter ($d_H$) and the zone (Z) are indicated in FIG. 5. FIG. 4 shows part of a temperature measurement area (6) in enlarged scale. The gray gradation of the usually colored infrared picture shown in FIG. 5 clearly indicates the local temperature measurement area (6) that occurs within a ring-shaped temperature area (5) in the core region of the roll (1). The temperature difference between the ring-shaped temperature area (5) and the local temperature measurement area (6) is 0.5° C. The adjacent paper layers (12) have a temperature of approx. 31.9° C.

We claim:

1. A process for initiating a premature roll change of a web to be unwound from a roll wound on a spool, comprising the steps of:

measuring temperature of the web at an end of the roll in a zone up to 150 mm away from a surface of the spool in a radial direction during a time that the roll has between 100% and 60% of its fully wound weight, using a non-contact measuring device;

determining a radial distance from the spool surface when a temperature difference greater≧to 0.5° C. is found between temperature measurement locations of the web in the zone and cooler adjacent areas; and storing the determined distance for triggering a signal that initiates a replacement of the roll when that distance is reached.

2. A process according to claim 1, wherein the measuring step includes measuring the temperature at the end of the roll during a time when the roll is being wound.

3. A process according to claim 1, wherein the measuring step includes measuring the temperature at the end of the roll during a time when the roll is being unwound.

4. A process as defined in claim 1, wherein the measuring step includes measuring the temperature at both ends of the roll.

5. A process as defined in claim 1, wherein the temperature measuring step includes measuring the temperature with an infrared camera having a resolution accuracy of at least 0.2° C.

* * * * *

UNITED STATES PATENT AND TRADEMARK OFFICE

CERTIFICATE OF CORRECTION

PATENT NO. : 5,769,353

DATED : June 23, 1998

INVENTOR(S) : Jühe, et al.

It is certified that error appears in the above-identified patent and that said Letters Patent is hereby corrected as shown below:

Column 4, line 5, delete "recordings" and insert --graphs--.

Column 5, line 5, delete "The" and replace with --Graphs of the--

Column 5, line 9, after "colored" insert --graph of the--.

Column 5, line 10, delete "picture" and replace with --temperatures recorded--.

Signed and Sealed this

Ninth Day of February, 1999

*Attest:*

*Acting Commissioner of Patents and Trademarks*

*Attesting Officer*